US012156569B2

(12) United States Patent
Ozawa et al.

(10) Patent No.: US 12,156,569 B2
(45) Date of Patent: Dec. 3, 2024

(54) SHOE TONGUE STRUCTURE AND SHOE

(71) Applicant: ASICS CORPORATION, Hyogo (JP)

(72) Inventors: Keita Ozawa, Hyogo (JP); Shigeyuki Mitsui, Hyogo (JP); Sho Takamasu, Hyogo (JP); Kenta Nakaya, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 51 days.

(21) Appl. No.: 17/788,235

(22) PCT Filed: Dec. 26, 2019

(86) PCT No.: PCT/JP2019/051096
§ 371 (c)(1),
(2) Date: Jun. 22, 2022

(87) PCT Pub. No.: WO2021/130955
PCT Pub. Date: Jul. 1, 2021

(65) Prior Publication Data

US 2023/0036575 A1 Feb. 2, 2023

(51) Int. Cl.
*A43B 23/26* (2006.01)

(52) U.S. Cl.
CPC ..... *A43B 23/26* (2013.01)

(58) Field of Classification Search
CPC ..... A43B 23/26
USPC ..... 36/54, 99
See application file for complete search history.

(56) References Cited

U.S. PATENT DOCUMENTS 994,187 A * 6/1911 Mumaw ..... A43C 11/24 24/713.2
1,272,137 A * 7/1918 Smith ..... A43B 23/28 36/50.1
1,677,226 A * 7/1928 Banks ..... A43B 7/1495 36/170
2,424,777 A * 7/1947 Stuart ..... A43B 23/028 428/102

(Continued)

FOREIGN PATENT DOCUMENTS

JP 298706 U 8/1990
JP 574303 U 10/1993

(Continued)

OTHER PUBLICATIONS

International Preliminary Report on Patentability issued Jun. 28, 2022 in corresponding International Application No. PCT/JP2019/051096.

(Continued)

*Primary Examiner* — Ted Kavanaugh
(74) *Attorney, Agent, or Firm* — Global IP Counselors, LLP

(57) ABSTRACT

A shoe tongue structure includes a first shoe tongue and a second shoe tongue arranged such as to cover an opening of an upper extending frontward from a foot insertion part. The first shoe tongue includes a first front end fixed to an edge of the opening and extends rearward from the first front end toward the lateral side of the foot insertion part. The second shoe tongue includes a second front end fixed to an edge of the opening and extends rearward from the second front end toward the medial side of the foot insertion part. The first front end is positioned on the medial side with respect to the second front end.

9 Claims, 10 Drawing Sheets

(56) References Cited

U.S. PATENT DOCUMENTS

| | | | | | |
|---|---|---|---|---|---|
| 4,486,965 | A * | 12/1984 | Friton | A43C 11/1493 | D2/978 |
| 5,024,006 | A | 6/1991 | Kiyosawa | | |
| 5,430,958 | A * | 7/1995 | Kiyosawa | A43B 23/26 | 36/83 |
| D899,066 | S * | 10/2020 | Liu | D2/896 | |
| 2015/0096107 | A1* | 4/2015 | Krumel | A41B 11/008 | 2/239 |

FOREIGN PATENT DOCUMENTS

| | | | | |
|---|---|---|---|---|
| JP | 584209 | U | 11/1993 | |
| JP | 928413 | A | 2/1997 | |
| WO | WO-2008059304 | A1 * | 5/2008 | A43B 5/16 |

OTHER PUBLICATIONS

International Search Report issued Mar. 10, 2020 in corresponding International Application No. PCT/JP2019/051096.

* cited by examiner

SHOE TONGUE STRUCTURE AND SHOE

CROSS-REFERENCE TO RELATED APPLICATION

This application is a U.S. National Stage application of International Application No. PCT/JP2019/051096, filed Dec. 26, 2019, the contents of which are incorporated herein by reference.

BACKGROUND

Field of the Invention

The present disclosure relates to a shoe tongue structure and a shoe provided with the shoe tongue structure.

Background Information

Conventional shoes generally include a shoe tongue provided between the upper portion and the instep. For example, Japanese Unexamined Utility Model Application Publication No. 02-98706 describes an athletic shoe including a first tongue piece and a second tongue piece that cover a U-shaped opening elongated from an opening for insertion of a foot. The first tongue piece is connected to one of opposed side rims on the U-shaped opening, and the second tongue piece is connected to the other opposed side rim. See also the specification of U.S. Pat. No. 5,024,006 and Japanese Unexamined Patent Application Publication No. 09-028413

SUMMARY

With regard to a shoe tongue structure, it has been determined that a shoe tongue provided in a shoe can reduce ingress of dust, sand, pebbles, and the like into the shoe. Meanwhile, when a user inserts a foot into the shoe, the shoe tongue in contact with the instep can get rolled and brought further into the shoe together with the instep, which is likely to cause discomfort to the user. A shoe tongue easily brought inside the shoe when the shoe is worn hinders swift wearing of the shoe.

To make the shoe tongue less likely to be brought inside when the shoe is worn, the shoe tongue can be divided into two tongue pieces in a width direction, and a side of each of the two tongue pieces can be fixed to the upper portion, as in the shoe described in Japanese Unexamined Utility Model Application Publication No. 02-98706. However, with this configuration, when the shoe is worn by a user with a high instep, a gap can be created between the two tongue pieces and the instep can be exposed, so that sand and pebbles can easily enter the shoe through the gap.

Therefore, it has been determined that there is room for improvement in the shoe tongue structure described in Japanese Unexamined Utility Model Application Publication No. 02-98706, in terms of making exposure of an instep less likely to occur even when a user with a high instep wears the shoe.

Embodiments of the present invention are described in view of such an issue, and a purpose of this disclosure is to provide a shoe tongue structure that makes exposure of an instep less likely to occur even when a user with a high instep wears the shoe.

In response to the above issue, a shoe tongue structure according to one embodiment of the present invention includes a first shoe tongue and a second shoe tongue arranged such as to cover an opening of an upper portion extending frontward from a foot insertion part. The first shoe tongue includes a first front end fixed to an edge of the opening and extends rearward from the first front end toward the lateral side of the foot insertion part. The second shoe tongue includes a second front end fixed to an edge of the opening and extends rearward from the second front end toward the medial side of the foot insertion part. The first front end is positioned on the medial side with respect to the second front end.

Optional combinations of the above, and embodiments of the present invention, including the constituting elements and expressions, in the form of methods, apparatuses, programs, transitory or non-transitory storage medium storing programs, or systems can also be practiced as additional modes or embodiments of the present invention.

Embodiments of the present invention provide a shoe tongue structure that makes exposure of an instep less likely to occur even when a user with a high instep wears the shoe.

BRIEF DESCRIPTION OF DRAWINGS

The invention will be explained in more detail hereinafter with reference to the drawings.

DETAILED DESCRIPTION

Figure 1:
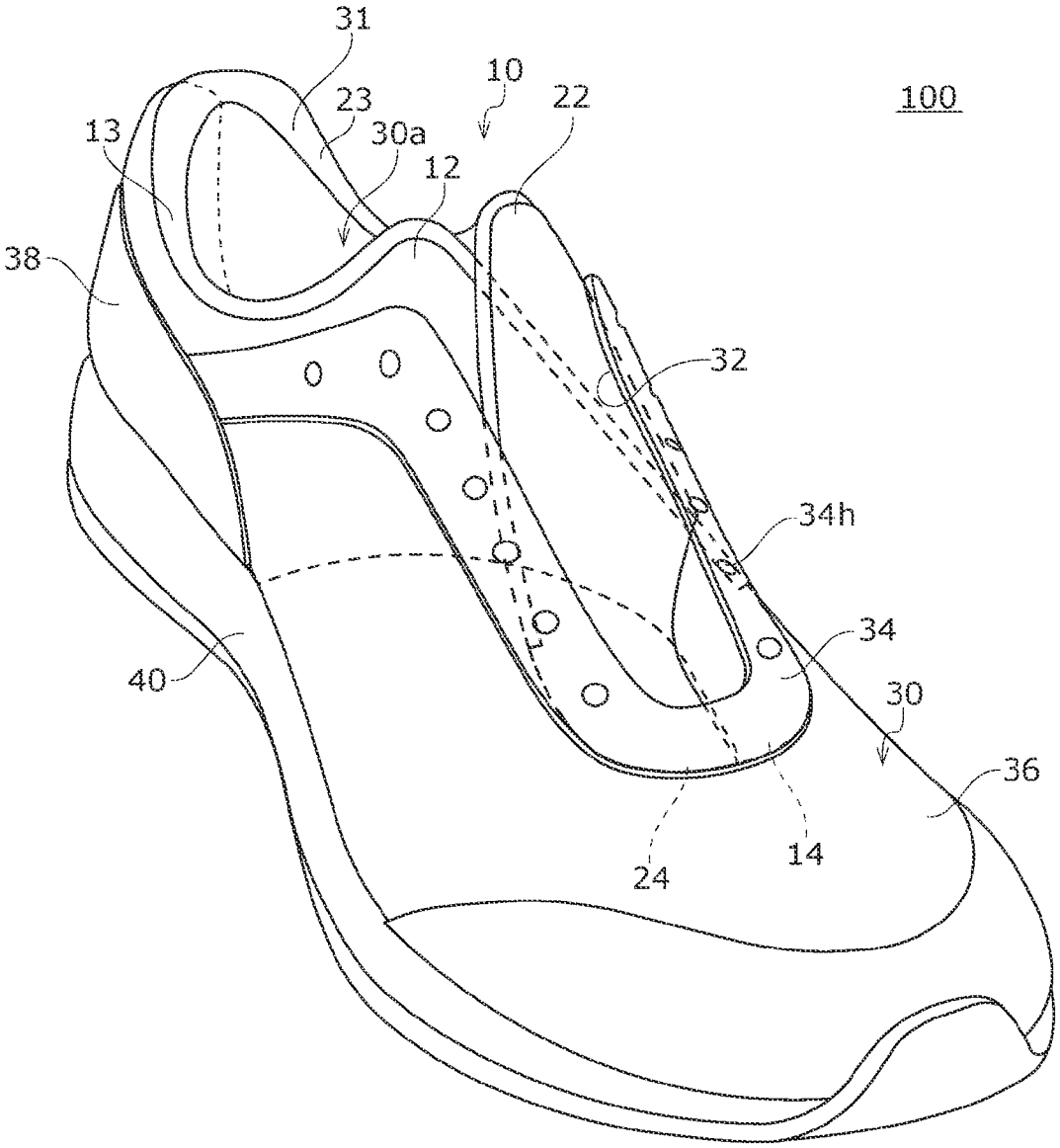
FIG. 1 is a perspective view that schematically illustrates a shoe provided with a shoe tongue structure according to an embodiment of the present invention.

In the following, the present invention will be described based on a preferred embodiment with reference to each drawing. In the embodiment and modifications, like reference characters denote like or corresponding constituting elements and members, and the repetitive description will be omitted as appropriate. Also, the dimensions of a member can be appropriately enlarged or reduced in each drawing in order to facilitate understanding. Further, in each drawing, part of members less important in describing the embodiment can be omitted.

Also, terms including ordinal numbers, such as "first" and "second", are used to describe various constituting elements; however, such terms are used in order to distinguish one constituting element from another and do not limit the constituting elements.

Embodiment

In the following, a configuration of a shoe 100 including a shoe tongue structure 10 according to an embodiment of the present invention will be described with reference to the drawings. FIG. 1 is a schematic perspective view of the shoe 100. Each drawing mentioned below, including FIG. 1, illustrates a shoe for a right foot, unless otherwise specified. However, the description in the present specification is also applicable to a shoe for a left foot.

The shoe 100 can be used for sports shoes for volleyball or basketball, for example. The shoe 100 can also be used for shoes for other sports such as tennis. The shoe 100 can also be used for walking shoes, running shoes, or safety shoes, and the use of the shoe 100 is not limited.

The shoe 100 includes shoe tongues 12 and 22, an upper portion 30, and a sole 40. The shoe tongues 12 and 22 include a first shoe tongue 12 on the lateral side and a second shoe tongue 22 on the medial side, which constitute the shoe tongue structure 10.

The upper portion 30 is fixed above the sole 40 by bonding or the like. The upper portion 30 includes a body part 36 that mainly covers a forefoot portion and a midfoot portion, and a heel surrounding part 38 that mainly covers a rearfoot portion. On an upper portion surface of the body part 36, an opening 32 extending frontward from a foot insertion part 31 is provided. Along the edge of the opening 32, an eyelet formation part 34 is provided. The eyelet formation part 34 is a portion of substantial U-shape and formed to have higher rigidity than its surrounding portion. In the eyelet formation part 34, multiple eyelets 34*h* are provided such that a shoelace, not illustrated, can be made to pass therethrough.

The sole 40 is a portion to be in contact with the ground. The sole 40 can be constituted by multiple members, such as an outsole, a midsole, and an insole, or can be constituted by a single material.

Figure 2:
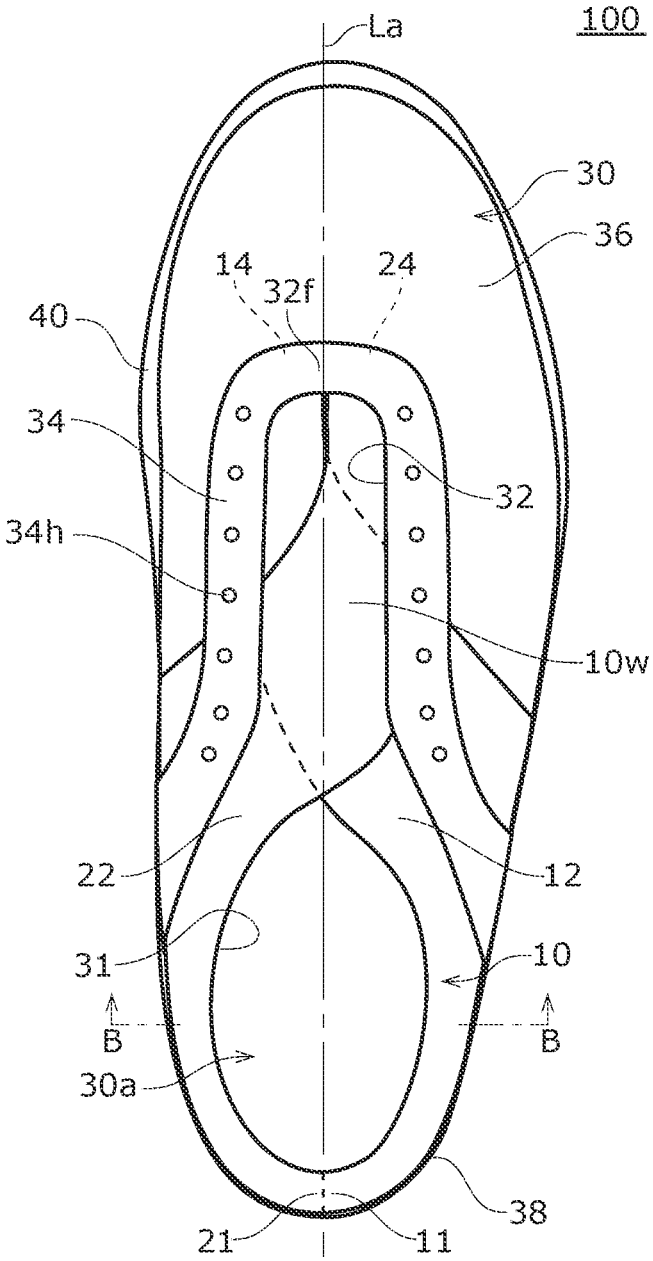
FIG. 2 is a plan view of the shoe shown in FIG. 1.

FIG. 2 is a plan view of the shoe 100. In the following, considering a state where the shoe 100 is placed on a horizontal plane, a width direction of the upper portion 30 will be simply referred to as a "width direction", a direction extending along a center line La with respect to a width direction of the upper portion 30 will be referred to as a "longitudinal direction", and a vertical direction will be referred to as a "vertical direction". A width direction, a longitudinal direction, and a vertical direction are perpendicular to each other.

Also, the direction from the heel toward the toe side of the upper portion 30 along the centers in a width direction will be referred to as the "front side" or "front", and the opposite direction will be referred to as the "rear side" or "rear". Also, the direction from the lateral side toward the medial side of the foot along a width direction will be referred to as the "inner side" or "inward", and the opposite direction will be referred to as the "outer side" or "outward". Further, the direction from the sole 40 toward the upper portion 30 along a vertical direction will be referred to as the "top side" or "above", and the opposite side will be referred to as the "lower side" or "below".

Also, a portion of the upper portion 30 located on the inner side with respect to the center line La will be referred to as a medial portion, and a portion of the upper portion 30 located on the outer side with respect to the center line La will be referred to as a lateral portion. Also, along a longitudinal direction, a portion of the upper portion 30 corresponding to the metatarsal bones will be referred to as the midfoot portion, a portion of the upper portion 30 located on the front side with respect to the midfoot portion will be referred to as the forefoot portion, and a portion of the upper portion 30 located on the rear side with respect to the midfoot portion will be referred to as the rearfoot portion. The forefoot portion almost corresponds to the phalanges, and the rearfoot portion almost corresponds to the tarsals.

Figure 3:
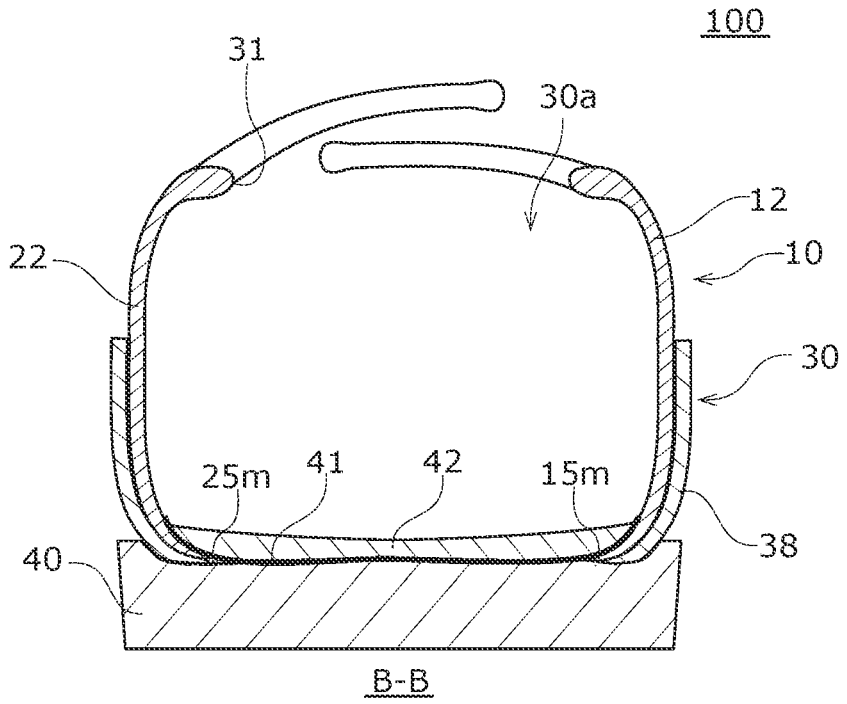
FIG. 3 is a longitudinal sectional view taken along line B-B in FIG. 2.
Figure 4:
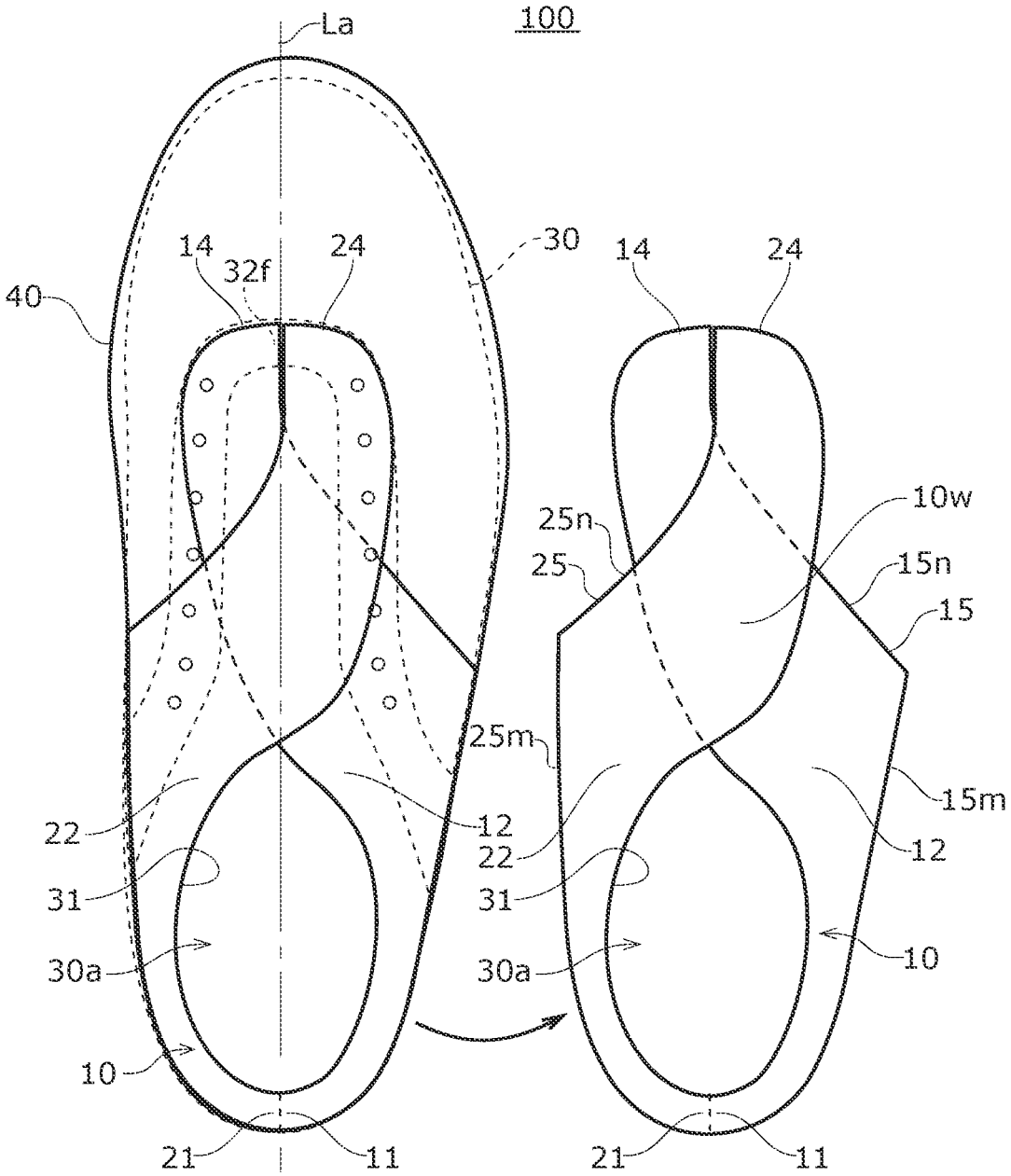
FIG. 4 is a plan view that illustrates shoe tongues shown in FIG. 1.
Figure 5:
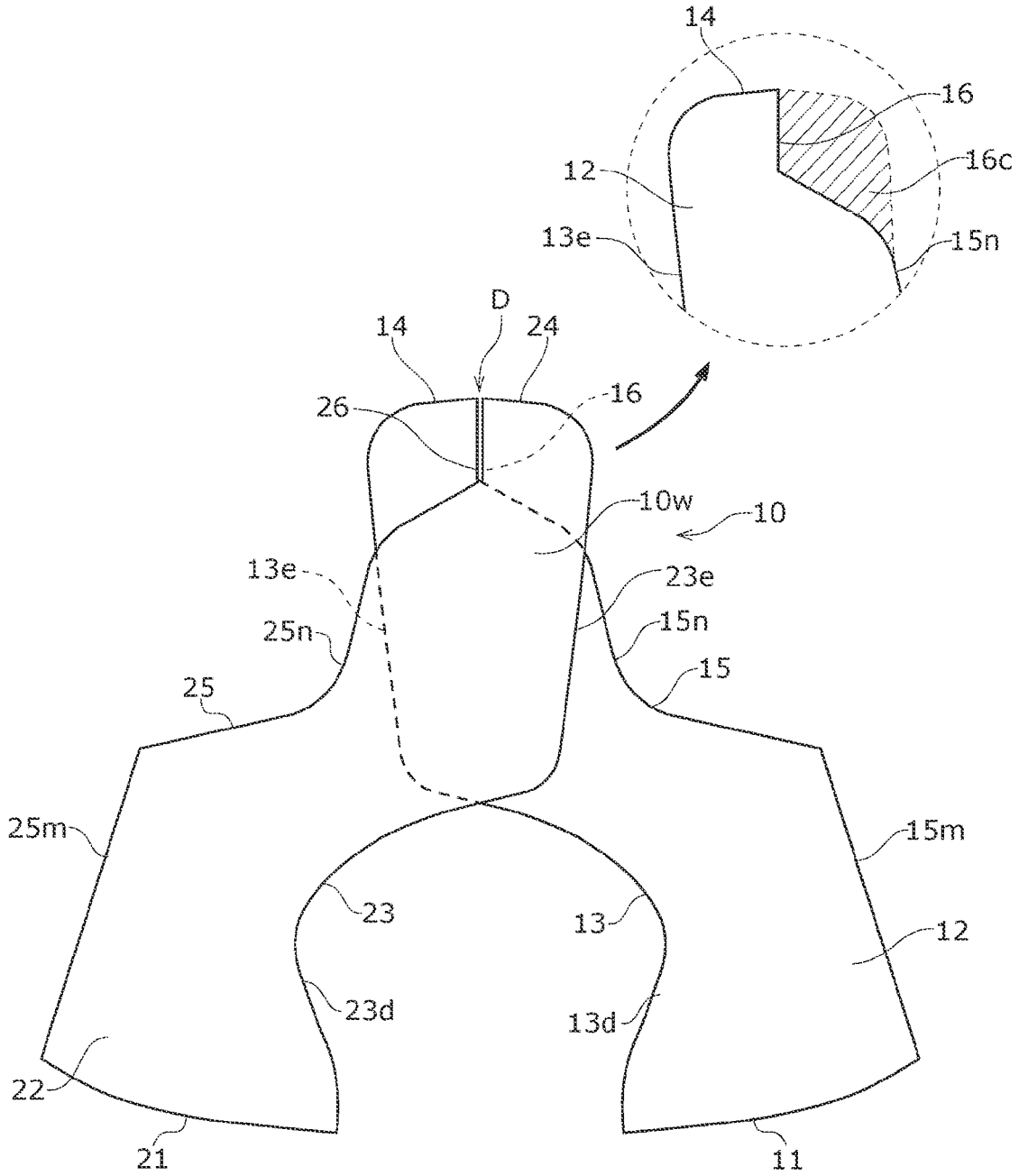
FIG. 5 is a developed plan view of the shoe tongues shown in FIG. 1.

Also with reference to FIGS. 3, 4, and 5, the shoe tongues 12 and 22 will be described. FIG. 3 illustrates a cross section of the shoe 100. FIG. 3 is a longitudinal sectional view taken along line B-B in FIG. 2. FIG. 4 is a plan view that shows the shoe tongues 12 and 22. FIG. 5 is a developed plan view of the shoe tongues 12 and 22. The shoe tongues 12 and 22 are arranged such as to cover the opening 32 of the upper portion 30 extending frontward from the foot insertion part 31.

In the present embodiment, the first shoe tongue 12 on the lateral side has a strip shape extending from a first front end 14 on the toe side to a first rear end 11 on the heel side. The first shoe tongue 12 includes, between the first front end 14 and the first rear end 11 on the heel side, an upper edge part 13 mostly positioned on the top side, and a lower edge part 15 mostly positioned lower than the upper edge part 13. The upper edge part 13 includes an upper projection part 13*d* that constitutes the foot insertion part 31, and a side edge part 13*e* provided on the front side with respect to the upper projection part 13*d*. The lower edge part 15 includes a lower fixed part 15*m* fixed to the upper portion 30 or the sole 40, and an unfixed part 15*n* provided on the front side with respect to the lower fixed part 15*m*.

In the present embodiment, the second shoe tongue 22 on the medial side has a strip shape extending from a second front end 24 on the toe side to a second rear end 21 on the heel side. The second shoe tongue 22 includes, between the second front end 24 and the second rear end 21 on the heel side, an upper edge part 23 mostly positioned on the top side, and a lower edge part 25 mostly positioned lower than the upper edge part 23. The upper edge part 23 includes an upper projection part 23*d* that constitutes the foot insertion part 31, and a side edge part 23*e* provided on the front side with respect to the upper projection part 23*d*. The lower edge part 25 includes a lower fixed part 25*m* fixed to the upper portion 30 or the sole 40, and an unfixed part 25*n* provided on the front side with respect to the lower fixed part 25*m*.

In the present embodiment, the shoe tongues 12 and 22 are integrally formed, with the rear ends 11 and 21 thereof connected with each other. In other words, the shoe tongues 12 and 22 are formed integrally and continuously. The developed view of FIG. 5 illustrates the shoe tongues 12 and 22 separated at the rear ends 11 and 21.

As shown in FIG. 1, rear portions of the shoe tongues 12 and 22 form an outline of a foot accommodation space 30*a*. With regard to the rear portions of the shoe tongues 12 and 22, lower parts thereof are surrounded by the heel surrounding part 38 of the upper portion 30, and upper parts thereof project upward from the heel surrounding part 38. The rear portions of the shoe tongues 12 and 22 are integrally configured with the upper portion 30. The upper projection parts 13*d* and 23*d* of the shoe tongues 12 and 22 project upward from the heel surrounding part 38 of the upper portion 30 and constitute the foot insertion part 31.

In the present embodiment, as shown in FIG. 3, the lower fixed part 15*m* of the first shoe tongue 12 on the lateral side is fixed, by means of bonding, sewing, or the like, to at least one of the upper portion 30 or the sole 40, in a region from the vicinity of the foot insertion part 31 to the first rear end 11. Also, the lower fixed part 25*m* of the second shoe tongue 22 on the medial side is fixed, by means of bonding, sewing, or the like, to at least one of the upper portion 30 or the sole 40, in a region from the vicinity of the foot insertion part 31 to the second rear end 21.

In the example of FIG. 3, on the sole 40, a bottom cloth 41 and an insole 42 are laminated. Each of the lower fixed parts 15*m* and 25*m* of the shoe tongues 12 and 22 is fixed, by sewing, to an end of the bottom cloth 41 together with a lower end of the heel surrounding part 38 of the upper portion 30. The bottom cloth 41 is bonded to the upper surface of the sole 40. The insole 42 is placed such as to cover, from the above, the lower fixed parts 15*m* and 25*m* and the lower end of the heel surrounding part 38 and to be in contact with the top side of the bottom cloth 41.

When a front portion of a shoe tongue is divided into two parts, there is a concern that, if a user with a high instep wears the shoe, the two shoe tongues can be shifted away from each other in the width directions and the instep can be exposed therebetween, so that sand and pebbles can enter therefrom. Meanwhile, the first shoe tongue 12 includes the first front end 14 fixed to a front end part 32*f* of the opening 32. The first shoe tongue 12 extends rearward from the first front end 14 toward the lateral side of the foot insertion part 31. Also, the second shoe tongue 22 includes the second front end 24 fixed to the front end part 32*f* of the opening 32. The second shoe tongue 22 extends rearward from the second front end 24 toward the medial side of the foot insertion part 31. The first front end 14 is positioned on the medial side with respect to the second front end 24. With this configuration, since the first and second shoe tongues 12 and 22 intersect on the instep, the instep is less likely to be exposed even when the two shoe tongues are shifted away from each other.

In the motion of inserting a foot into the shoe 100, the little toe side is inserted before the toes, including the hallux, are inserted into the shoe 100 while the foot is rotated. This rotation is counterclockwise when the right foot is viewed from behind, for example, and if the little toe gets caught on an edge of a shoe tongue, the shoe tongue can get stuck in the toes. Accordingly, in the present embodiment, the vertical positional relationship between the shoe tongues is defined. More specifically, as shown in FIG. 4, the shoe tongues 12 and 22 include an overlapping portion 10*w* where the shoe tongues vertically overlap each other. In the overlapping portion 10*w*, the first shoe tongue 12 is positioned below the second shoe tongue 22. In this case, when a foot is inserted, the little toe moves on the inner surface of the first shoe tongue 12 along the extending direction. Accordingly, the shoe tongue is less likely to get stuck in the toes, so that the foot can be inserted smoothly.

If the entire edge of a shoe tongue is fixed to the upper portion 30, the movement of the shoe tongue can be restricted, which can reduce the fit to the instep. Accordingly, in the present embodiment, an unfixed part is provided on an edge of each shoe tongue. More specifically, as shown in FIG. 4, the first shoe tongue 12 includes an unfixed part 15*n*, which is not fixed to the upper portion 30, between the vicinity of the foot insertion part 31 and the first front end 14. Also, the second shoe tongue 22 includes an unfixed part 25*n*, which is not fixed to the upper portion 30, between the vicinity of the foot insertion part 31 and the second front end 24. In this case, near the unfixed parts 15*n* and 25*n*, the shoe tongues 12 and 22 can move relatively freely in the width directions. Therefore, when the instep is high, the shoe tongues 12 and 22 move away from each other to fit the instep, and, when the instep is low, the shoe tongues 12 and 22 move closer to each other to fit the instep.

If the shoe tongues entirely overlap each other, the instep can be pressed, and the smoothness for the foot can be reduced. Accordingly, in the present embodiment, a cutout part is provided in a front portion of each shoe tongue. More specifically, as shown in FIG. 5, on the lateral side of the first shoe tongue 12, a cutout part 16, which is cut out rearward from the first front end 14, is provided. Also, on the medial side of the second shoe tongue 22, a cutout part 26, which is cut out rearward from the second front end 24, is provided.

The cutout part 16 is a portion where a hatched region 16*c* on the lateral side of the front end 14 is cut out from the overlapping portion 10*w*, as shown in FIG. 5. Also, as with the cutout part 16, the cutout part 26 is a portion where the medial side of the front end 24 is cut out from the overlapping portion 10*w*.

As shown by arrow D in FIG. 5, the first front end 14 is spaced away from the second front end 24 in a width direction. In this case, near the front ends 14 and 24, the overlapping area of the shoe tongues 12 and 22 is reduced, which improves the smoothness for the instep compared to the case without the cutout parts. In FIG. 5, the gap between the shoe tongues is drawn larger to facilitate understanding. The gap can desirably be set so that, in a state where a foot is not inserted, lines extending respectively in the longitudinal directions of the first front end 14 and the second front end 24 come into contact with each other.

Figure 6:
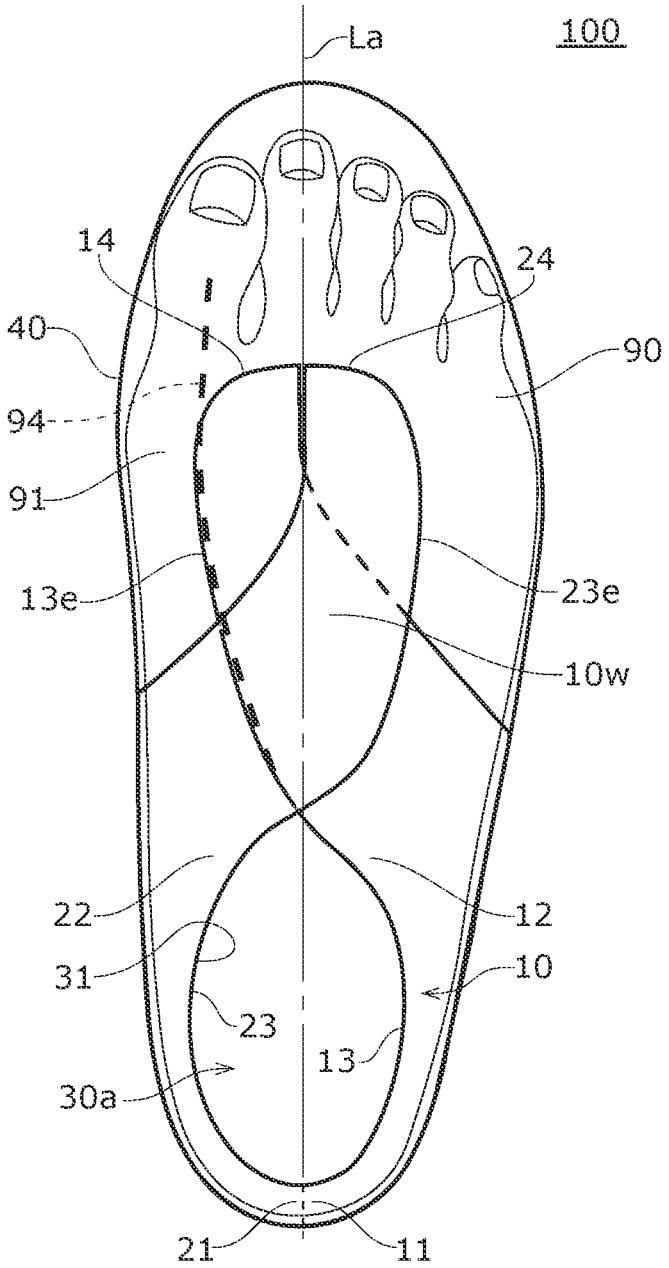
FIG. 6 is a plan view that illustrates an example of a relationship between a shoe tongue shown in FIG. 1 and a ridge of a foot.

With reference to FIG. 6, a relationship between the side edge part 13*e* of the first shoe tongue 12 and an upper surface ridge 94 of an instep 91 will be described. FIG. 6 is a plan view that illustrates a relationship between the first shoe tongue 12 and the upper surface ridge 94 of the instep 91. The upper surface ridge 94 is a line connecting the highest points of the instep 91. The side edge part 13*e* is a portion of the upper edge part 13 that covers the instep 91 on the front side with respect to the foot insertion part 31.

In order to improve the smoothness for a foot, the side edge part 13*e* can desirably be positioned on the medial side with respect to the center line La. From a similar point of view, the side edge part 13*e* can more desirably be positioned on the medial side with respect to a portion of the upper portion 30 corresponding to the upper surface ridge 94. Accordingly, in the present embodiment, the first shoe tongue 12 has a shape that partly covers a portion of the upper portion 30 corresponding to the upper surface ridge 94 of the instep 91. In this case, the side edge part 13*e* on the medial side of the first shoe tongue 12 is less likely to come into contact with the upper surface ridge 94, so that the smoothness for the instep 91 in this portion can be further improved.

Figure 7:
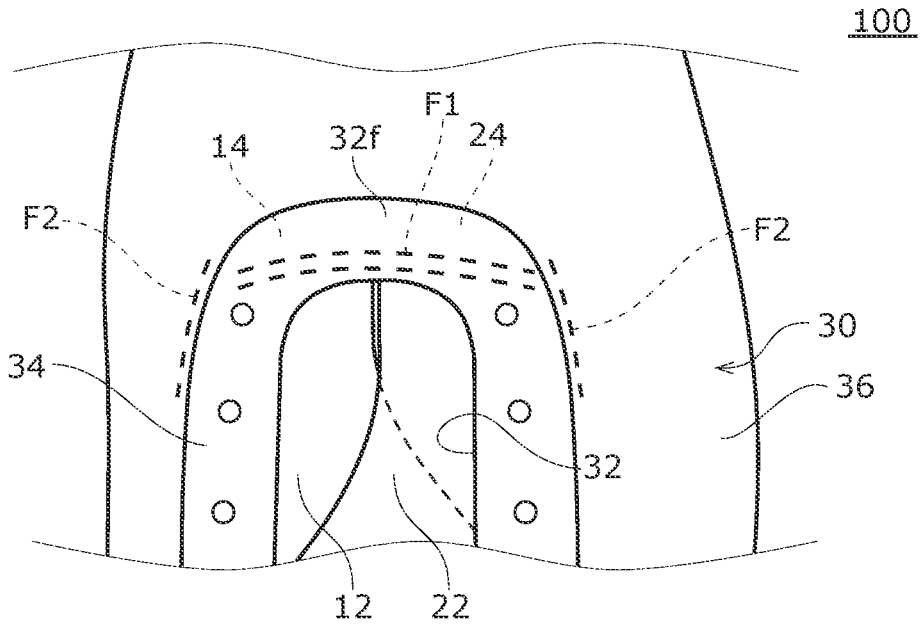
FIG. 7 is a diagram that shows an example of a fixed position of a front end of each shoe tongue shown in FIG. 1.

With reference to FIG. 7, fixed positions of the first front end 14 and the second front end 24 will be described. FIG. 7 is a diagram that shows fixed positions of the front ends 14 and 24 of the shoe tongues 12 and 22. The fixed positions of the front ends 14 and 24 are not limited. For example, as shown by F1 in FIG. 7, each of the front ends 14 and 24 can be fixed to a throat part (the front end part 32*f*) of the upper portion 30. Also, as shown by F2 in FIG. 7, each of the front ends 14 and 24 can be fixed to a portion extending rearward from the front side part of the eyelet formation part 34. Also, each of the front ends 14 and 24 can be fixed at both the F1 position and the F2 position. In the present embodiment, the front ends 14 and 24 are fixed to the upper portion 30 by sewing.

Figure 8:
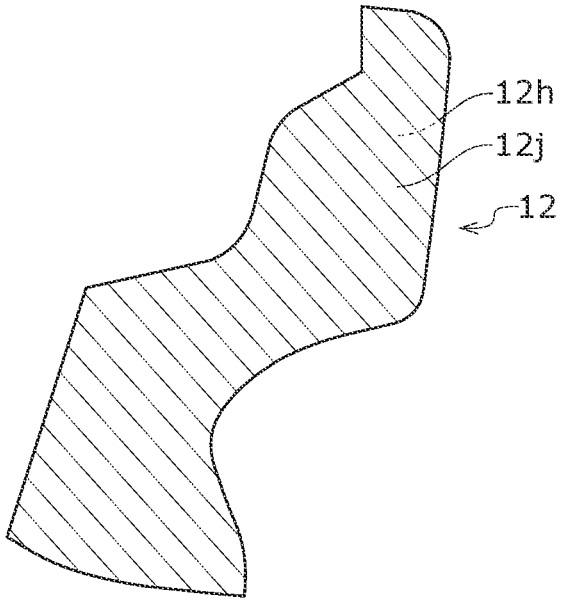
FIG. 8 is a developed view that illustrates an example of an inner surface of a shoe tongue shown in FIG. 1.
Figure 9:
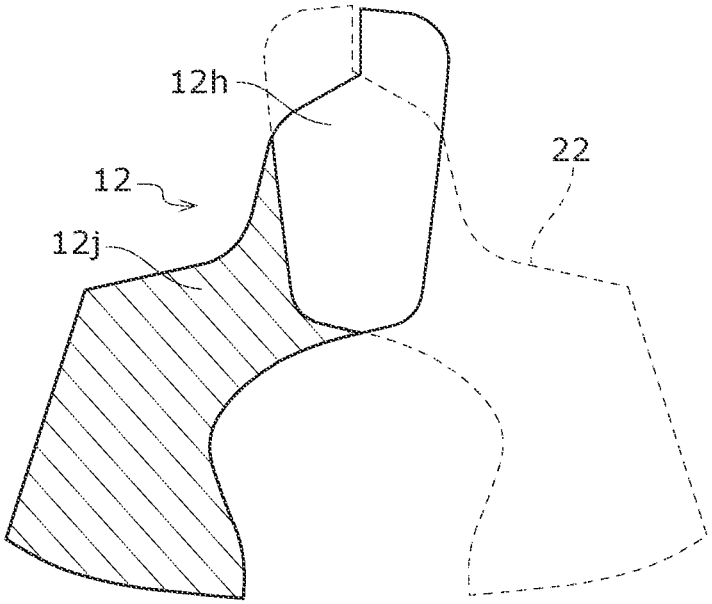
FIG. 9 is another developed view that illustrates an example of the inner surface of a shoe tongue shown in FIG. 1.

With reference to FIGS. 8 and 9, an outer surface material and a lining material of a shoe tongue will be described. FIGS. 8 and 9 are developed views of the first shoe tongue 12 viewed from the inner surface, and the hatching therein indicates a region where the lining material extends. Although the embodiment describes an outer surface material 12*h* and a lining material 12*j* of the first shoe tongue 12, the description is similarly applicable to the outer surface material and the lining material of the second shoe tongue 22. The shoe tongue 12 includes the outer surface material 12*h* provided on the upper surface, and the lining material 12*j* provided on the opposite side from the outer surface material 12*h*. The material of the outer surface material 12*h* of the shoe tongue is not limited. For example, the outer surface material 12*h* can be formed of polyester, nylon, artificial leather, natural leather, or the like. Also, the forefoot portion side of the outer surface material 12*h* can be made of a material having higher stretchability than the rearfoot portion side of the outer surface material 12*h*, for example. In this case, the smoothness for a foot can be improved.

As illustrated in FIG. 8, the lining material 12*j* of the present embodiment extends over a range where the outer surface material 12*h* extends. In other words, the outer surface material 12*h* is disposed over the entire outer surface of the shoe tongue 12, and the lining material 12*j* is disposed over the entire inner surface of the shoe tongue 12. The lining material 12*j* can be made of a material having higher stretchability than the outer surface material 12*h*. In this case, the smoothness for a foot can be improved while the rigidity of the shoe tongue is ensured.

The lining material 12*j* can be disposed on only part of the inner surface of the shoe tongue. For example, as illustrated in FIG. 9, the lining material 12*j* can be disposed on only a portion located on the rear side of the position where the other shoe tongue 22 intersects. In this case, the lining material 12*j* can have stretchability or no stretchability.

Also, the range where the lining material 12*j* is disposed on the first shoe tongue 12 can be different from the range where the lining material 12*j* is disposed on the second shoe tongue 22. For example, the lining material 12*j* can be disposed over the entire inner surface of the first shoe tongue 12, whereas, on the inner surface of the second shoe tongue 22, the lining material 12*j* can be disposed only on the rear side with respect to the portion where the first shoe tongue 12 overlaps. In this case, the thickness of the shoe tongues can be reduced, and the stretchability can be ensured.

The ranges where the lining material 12*j* and the outer surface material 12*h* are fixed can be set based on desired stretch properties. For example, the lining material 12*j* and the outer surface material 12*h* can be fixed to each other on their entire surfaces, or only their end parts can be fixed to each other. Also, the lining material 12*j* and the outer surface material 12*h* can be fixed to each other by sewing or taping or can be fixed to each other with an adhesive, such as a hot-melt adhesive.

Figure 10:
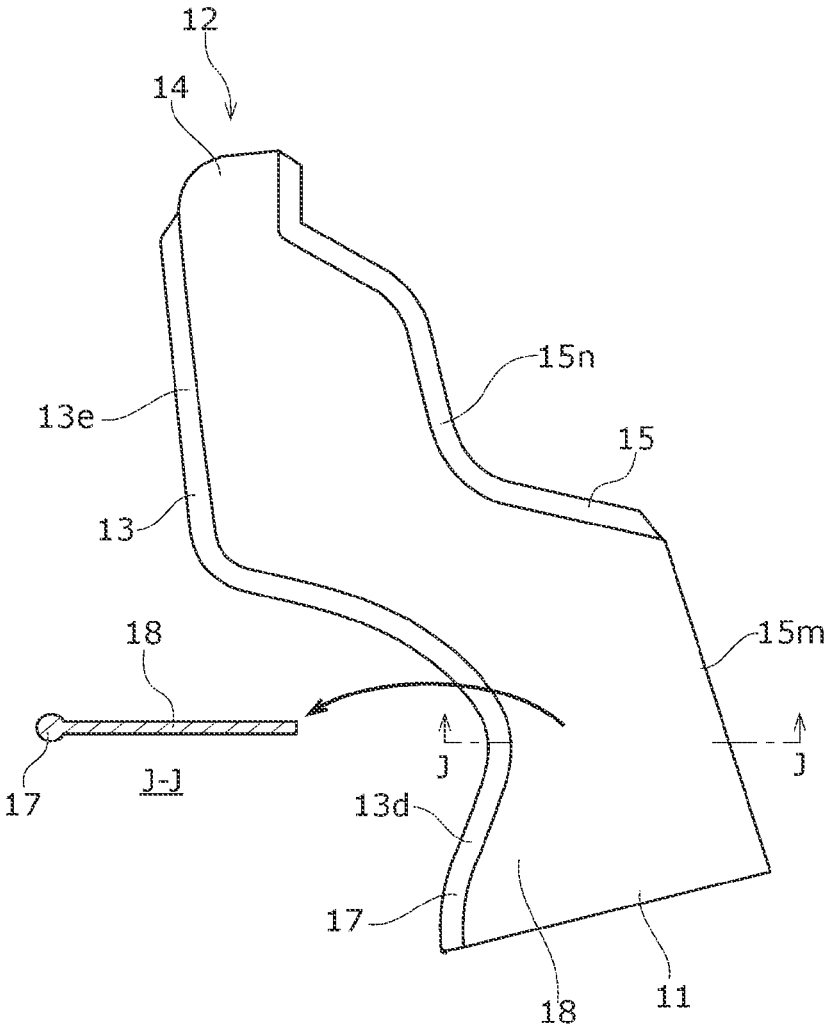
FIG. 10 is a diagram that illustrates an example of a thick edge part of a shoe tongue shown in FIG. 1.

With reference to FIG. 10, a thick edge part of a shoe tongue will be described. FIG. 10 is a diagram that illustrates an example of a thick edge part 17 of the first shoe tongue 12. Although the embodiment describes the thick edge part 17 and a surrounded part 18 of the first shoe tongue 12, the description is similarly applicable to the thick edge part and the surrounded part of the second shoe tongue 22.

If the entire shoe tongue is thick, the stretchability can decrease, which can reduce the smoothness for a foot. In addition, the shoe can feel tight. Accordingly, in the present embodiment, the thick edge part 17 is provided around a perimeter of the shoe tongue 12, and the surrounded part 18 surrounded by the thick edge part 17 is formed thinner than the thick edge part 17. In this case, the thickness of the surrounded part 18 can be reduced, so that the stretchability can be ensured. In the example of FIG. 10, the shoe tongue 12 is bordered by the thick edge part 17 formed of a cushioning material, and the surrounded part 18 surrounded by the thick edge part 17 is formed thinner than the thick edge part 17.

The thick edge part 17 can be provided around the entire perimeter of the shoe tongue 12. In the example of FIG. 10, the thick edge part 17 is provided along edge parts to be in contact with a foot, such as the upper portion edge part 13 and the unfixed part 15*n* of the lower edge part 15. In a portion fixed to another member, such as the lower fixed part 15*m* or the front end 14, the thick edge part 17 is not provided.

There will now be described the features of the shoe tongue structure 10 of the present embodiment configured as described above. The shoe tongue structure 10 includes the first shoe tongue 12 and the second shoe tongue 22 arranged such as to cover the opening 32 of the upper portion 30 extending frontward from the foot insertion part 31. The first shoe tongue 12 includes the first front end 14 fixed to an edge of the opening 32 and extends rearward from the first front end 14 toward the lateral side of the foot insertion part 31. The second shoe tongue 22 includes the second front end 24 fixed to an edge of the opening 32 and extends rearward from the second front end 24 toward the medial side of the foot insertion part 31. The first front end 14 is positioned on the medial side with respect to the second front end 24.

With this configuration, since the first and second shoe tongues 12 and 22 intersect on the instep, even when a user with a high instep wears the shoe, the instep is less likely to be exposed.

In the present embodiment, the first shoe tongue 12 and the second shoe tongue 22 include the overlapping portion 10*w* where the shoe tongues vertically overlap each other, and, in the overlapping portion 10*w*, the first shoe tongue 12 is positioned below the second shoe tongue 22. In this case, since the shoe tongues are less likely to get stuck in the toes, the foot can be smoothly inserted into the shoe 100.

In the present embodiment, at least one of the first shoe tongue 12 or the second shoe tongue 22 includes the unfixed part 15*n* or 25*n*, which is not fixed to the upper portion 30, on the front side with respect to the foot insertion part 31. In this case, since the moving range of the shoe tongue increases depending on the instep height, the shoe tongue appropriately fits the instep.

In the present embodiment, the lateral side of the first shoe tongue 12 is cut out rearward from the first front end 14, the medial side of the second shoe tongue 22 is cut out rearward from the second front end 24, and the first front end 14 is spaced away from the second front end 24 in a width direction. In this case, the smoothness for the instep near the front ends of the shoe tongues can be improved.

In the present embodiment, the first shoe tongue 12 has a shape that covers a portion of the upper portion 30 corresponding to the upper surface ridge 94 of the instep 91. In this case, the smoothness for a foot at the upper surface ridge can be improved.

In the present embodiment, at least one of the first shoe tongue 12 or the second shoe tongue 22 includes the outer surface material 12*h* provided on the upper surface, and the lining material 12*j* provided on the opposite side from the outer surface material 12*h*. The lining material 12*j* extends over the range where the outer surface material 12*h* extends. In this case, with the lining material 12*j* made of a material having higher stretchability than the outer surface material 12*h*, feeling of smoothness for a foot can be improved.

In the present embodiment, the thick edge part 17 is provided around a perimeter of at least one of the first shoe tongue 12 or the second shoe tongue 22, and the surrounded part 18 surrounded by the thick edge part 17 is formed thinner than the thick edge part 17. In this case, the surrounded part 18 surrounded by the thick edge part 17 can be made thinner to ensure the stretchability of the shoe tongue.

Since the shoe 100 according to the present embodiment is provided with the shoe tongue structure 10, the shoe 100 has the same features as the shoe tongue structure 10.

An exemplary embodiment of the present invention has been described in detail. The abovementioned embodiment merely describes a specific example for carrying out the present invention. The embodiment is not intended to limit the technical scope of the present invention, and various design modifications, including changes, addition, and deletion of constituting elements, can be made to the embodiment without departing from the scope of ideas of the invention defined in the claims. In the aforementioned embodiment, matters to which design modifications can be made are described with the expression of "of the embodiment", "in the embodiment", or the like. However, design modifications can also be made to matters without such expression.

In the following, modifications will be described. In the drawings and description of the modifications, like reference characters denote like or corresponding constituting elements and members in the embodiment. Repetitive description already provided in the embodiment will be omitted as appropriate, and configurations different from those in the embodiment will be intensively described.

First Modification

Figure 11:
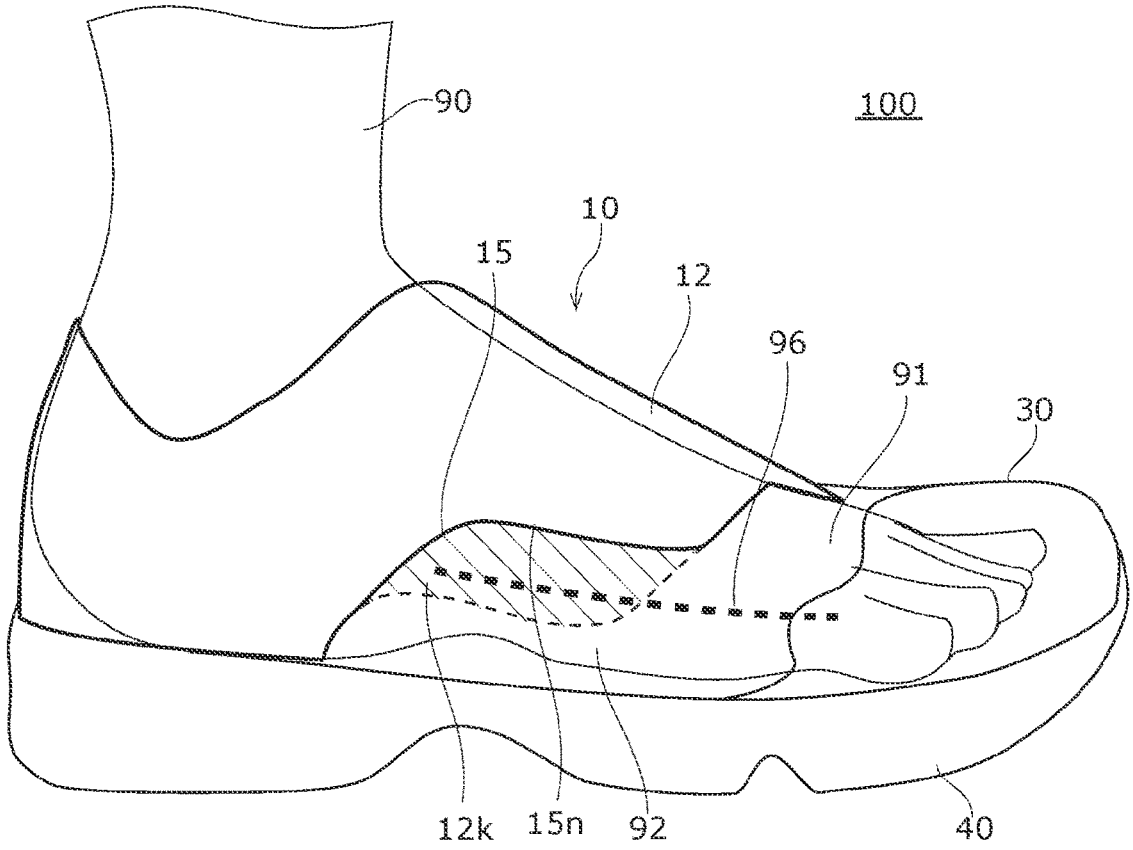
FIG. 11 is a side view that illustrates an example of a side shape of a shoe tongue shown in FIG. 1.

With reference to FIG. 11, the shoe tongue structure 10 according to a first modification will be described. FIG. 11 is a side view that illustrates an example of a side shape of the first shoe tongue 12. FIG. 11 illustrates a state viewed from the lateral side in which the upper portion 30 is partly cut out and the second shoe tongue 22 is omitted. Although the modification describes a side shape of the first shoe tongue 12, the description is similarly applicable to a side shape of the second shoe tongue 22. The present modification differs from the embodiment in side shapes of the shoe tongues 12 and 22, and the other configurations are similar to those in the embodiment. Accordingly, the side shapes will be intensively described.

In FIG. 11, the first shoe tongue 12 in the embodiment is indicated by a thick solid line. In the embodiment, the first shoe tongue 12 does not cover a side surface ridge 96 of the forefoot portion on a foot side surface 92. In the shoe tongue 12 of the present modification, however, a projecting part 12*k* (the hatched region) is provided to cover the side surface ridge 96 of the forefoot portion on the foot side surface 92. The side surface ridge 96 is a line forming an outer contour of the instep 91 in plan view. In other words, the side surface ridge 96 is a line connecting the outermost points of the outer contour in plan view.

The projecting part 12*k* has a shape that partly covers a portion of the upper portion 30 corresponding to the side surface ridge 96 of the forefoot portion on the foot side surface 92. In particular, the projecting part 12*k* extends to a position lower than the portion of the upper portion 30 corresponding to the side surface ridge 96. Thus, by extending the side surface of the shoe tongue 12, differences in the height of the instep 91 and the width of a foot 90 can be accommodated. The thickness of the projecting part 12*k* can be uniform, or the portion below the side surface ridge 96 can be made thinner than the portion above the side surface ridge 96.

Other Modifications

Although the embodiment describes an example in which the cutout parts 16 and 26 are provided in the first and second front ends 14 and 24, one or both of the cutout parts 16 and 26 need not necessarily be provided. When the cutout parts are not provided, the first and second front ends 14 and 24 can be formed of a material with a thickness equal to or less than that of the surrounded part 18, for example.

Although the embodiment describes an example in which the rear portions of the shoe tongues 12 and 22 are integrally formed with the upper portion 30, the present invention is not limited thereto. The shoe tongues 12 and 22 can be formed separately from the upper portion 30 and can be individually connected to the upper portion 30.

Although the embodiment describes an example in which the rear portions of the shoe tongues 12 and 22 are connected with each other, the present invention is not limited thereto. The shoe tongues 12 and 22 can be separated from each other.

One or more of the hardness, thickness, and stretchability of the shoe tongue 12 can differ from those of the shoe tongue 22. For example, when the shoe tongues are attached to a running shoe, for the purpose of controlling running motions such as overpronation, the second shoe tongue can be formed of a material having higher hardness and higher rigidity than the first shoe tongue, can be configured thicker than the first shoe tongue, or can be made of a material having lower stretchability than the first shoe tongue.

As another example, when the shoe tongues are attached to a shoe used in a sport in which side stepping is important, for the purpose of supporting a foot stepping sideways, the first shoe tongue can be formed of a material having higher hardness and higher rigidity than the second shoe tongue, can be configured thicker than the second shoe tongue, or can be made of a material having lower stretchability than the second shoe tongue. Such shoes include tennis shoes, basketball shoes, and handball shoes.

Although the embodiment describes an example in which a shoelace is provided, providing a shoelace is not essential. When a shoelace is not used, a shoe tongue can be made of a stretchable material so that tightening force is applied by the shoe tongue.

The shoe tongues 12 and 22 need not necessarily be constituted by separate members and can be an integrated member when developed.

In the shoe tongues 12 and 22, the overlapping portion 10*w*, in which the shoe tongues vertically overlap each other, and unfixed portions in front of the overlapping portion 10*w* can be set higher in stretchability than the other parts of the shoe tongues 12 and 22 and the other parts of the upper portion 30. In this case, since the front and rear ends of the shoe tongues are fixed while middle portions are unfixed, stretching of the unfixed portions can absorb a difference in the instep height for each user and can also adjust the fit. Also, since the portions in the rear of the overlapping portion 10*w* have relatively lower stretchability than the overlapping portion 10*w*, reduction in holding properties for the foot can be prevented. More specifically, the unfixed portions in front of the overlapping portion 10*w* can be formed of a material different from that of the portions in the rear of the overlapping portion 10*w*. For example, a configuration can be considered in which the portions in front of the overlapping portion 10*w* are formed of a material with a coarser mesh than the portions in the rear of the overlapping portion 10*w*. By using jacquard meshes, the mesh coarseness can be varied for each part. Also, a configuration in which spandex is used for the portions with higher stretchability can be adopted. Further, a configuration in which the lining material is not provided in the portions with higher stretchability, or a configuration in which the method of fixing the lining material in such portions is changed can also be adopted.

Although the embodiment describes an example in which the front ends 14 and 24 of the shoe tongues 12 and 22 are fixed to the upper portion 30 by sewing, the present invention is not limited thereto. The front ends 14 and 24 can be fixed to the upper portion 30 by various publicly-known fixing methods other than sewing.

Although the embodiment describes an example in which the foot insertion part 31 is constituted by the shoe tongues 12 and 22, the present invention is not limited thereto. The foot insertion part 31 can be constituted by the upper portion 30.

Although the embodiment describes an example in which the rear portions of the shoe tongues 12 and 22 form the outline of the foot accommodation space 30*a*, the present invention is not limited thereto. The outline of the foot accommodation space 30*a* can be formed by the upper portion 30.

Each of the abovementioned modifications provides functions and effects similar to those of the aforementioned embodiment.

Optional combinations of the aforementioned embodiment and modifications can also be practiced as additional embodiments of the present invention. Such an additional embodiment made by combination has the effect of each of the combined embodiment and modifications.

Embodiments of the present invention relate to a shoe and are applicable to a shoe.

The invention claimed is:

1. A shoe comprising:

a sole;

an upper fixed above the sole, the upper including a foot insertion part and an opening extending frontward from the foot insertion part; and a shoe tongue structure including a first shoe tongue and a second shoe tongue, the first shoe tongue and the second shoe tongue configured and arranged such as to cover the opening of the upper extending frontward from the foot insertion part, the first shoe tongue including a first front end fixed to an edge of the opening and to at least one of the upper and the sole at a lateral side of the foot insertion part and extending rearward from the first front end toward the lateral side of the foot insertion part, the second shoe tongue including a second front end fixed to the edge of the opening and to at least one of the upper and the sole at a medial side of the foot insertion part and extending rearward from the second front end toward a medial side of the foot insertion part, the first front end positioned on the medial side with respect to the second front end, a lateral side of the first shoe tongue is cut out rearward from the first front end, a medial side of the second shoe tongue is cut out rearward from the second front end, and the first front end is spaced away from the second front end in a width direction.

2. The shoe according to claim 1, wherein the first shoe tongue and the second shoe tongue include an overlapping portion where the first and second shoe tongues vertically overlap each other to form an overlapping portion, and in the overlapping portion, the first shoe tongue is positioned below the second shoe tongue.

3. The shoe according to claim 1, wherein at least one of the first shoe tongue or the second shoe tongue includes an unfixed part that is not fixed to the upper, on a front side with respect to the foot insertion part.

4. The shoe according to claim 1, wherein the first shoe tongue has a shape that is configured to cover a portion of the upper corresponding to an upper surface ridge of an instep.

5. The shoe according to claim 1, wherein at least one of the first shoe tongue or the second shoe tongue includes an outer surface material provided on an upper surface, and a lining material provided on the opposite side from the outer surface material, and the lining material extends over a range where the outer surface material extends.

6. The shoe according to claim 1, wherein a thick edge part is provided around a perimeter of at least one of the first shoe tongue or the second shoe tongue, and a portion surrounded by the thick edge part is formed thinner than the thick edge part.

7. The shoe according to claim 1, wherein at least one of the first shoe tongue or the second shoe tongue includes a projecting part that is configured to cover a portion of the upper corresponding to a side surface ridge of a forefoot portion on a foot side surface.

8. The shoe according to claim 1, further comprising an overlapping portion where the first and second shoe tongues vertically overlap each other and unfixed portions in front of the overlapping portion have higher stretchability than other parts of the first shoe tongue and the second shoe tongue.

9. The shoe according to claim 1, wherein the first front end is spaced away from the second front end in the width direction so as to form a gap therebetween.

* * * * *